US005687800A

United States Patent [19]

Wilkening

[11] Patent Number: 5,687,800

[45] Date of Patent: Nov. 18, 1997

[54] APPARATUS AND METHOD FOR RETAINING A GRADER BLADE

[75] Inventor: Kevin J. Wilkening, Peoria, Ill.

[73] Assignee: Caterpillar Inc., Peoria, Ill.

[21] Appl. No.: 762,689

[22] Filed: Dec. 11, 1996

[51] Int. Cl.[6] ..... E02F 3/76

[52] U.S. Cl. ..... 172/811; 172/781; 172/741

[58] Field of Search ..... 172/272, 273, 172/274, 275, 305, 476, 507, 667, 673, 719, 741, 797, 781, 811; 414/138 C, 145 A; 403/23, 24, 374; 280/456 R, 460 R

[56] References Cited

U.S. PATENT DOCUMENTS

| | | | |
|---|---|---|---|
| 2,799,099 | 7/1957 | Leliter | 37/156 |
| 3,463,243 | 8/1969 | Fisher | 172/781 |
| 3,465,829 | 9/1969 | Fisher | 172/743 |
| 3,593,806 | 7/1971 | Gurries | 172/741 |
| 3,983,945 | 10/1976 | Hart et al. | 172/741 |
| 4,058,174 | 11/1977 | Atherton | 172/781 |
| 4,060,254 | 11/1977 | Ernst | 280/461 |
| 4,074,767 | 2/1978 | Cole | 172/781 |
| 4,084,643 | 4/1978 | Easterling | 172/795 |
| 4,105,078 | 8/1978 | Gilbert | 172/741 X |
| 4,237,986 | 12/1980 | Frisbee | 172/805 |
| 4,265,319 | 5/1981 | Seaberg | 172/811 |
| 4,683,959 | 8/1987 | Clemens | 172/795 |
| 4,821,808 | 4/1989 | Gurries | 172/811 X |
| 5,076,370 | 12/1991 | Stubben | 172/781 |
| 5,129,336 | 7/1992 | Vos | 111/101 |
| 5,191,943 | 3/1993 | Minor | 172/393 |

*Primary Examiner*—Terry Lee Melius
*Assistant Examiner*—Robert Pezzuto
*Attorney, Agent, or Firm*—William B. Heming; Paul J. Maginot

[57] ABSTRACT

An apparatus for retaining a grader blade includes a support bracket, a first upper retainer secured to the support bracket and a second upper retainer secured to the support bracket. The apparatus also includes a first lower retainer secured to the support bracket, the first lower retainer being movable relative to the first upper retainer, and a second lower retainer secured to the support bracket, the second lower retainer being movable relative to the second upper retainer. The apparatus further includes a first adjustment member which contacts the first lower retainer, wherein rotation of the first adjustment member causes movement of the first lower retainer relative to the first upper retainer, and a second adjustment member which contacts the second lower retainer, wherein rotation of the second adjustment member causes movement of the second lower retainer relative to the second upper retainer. A method of retaining a grader blade relative to a support bracket is also disclosed.

19 Claims, 10 Drawing Sheets

APPARATUS AND METHOD FOR RETAINING A GRADER BLADE

BACKGROUND OF THE INVENTION

The present invention relates generally to a grader, and more particularly to an apparatus and method for retaining a grader blade.

During a construction operation the displacement, distribution and leveling of material, such as dirt, is often required. A vehicle known as a grader is typically used to perform the above mentioned work functions.

A grader includes a tractor unit coupled to a grader group via a tow bar assembly. The tractor unit moves the grader group over the ground. The grader group includes a circle assembly and a blade assembly having a grader blade. The grader group also includes a support bracket having retainers extending therefrom. The blade assembly is positioned in the retainers such that the grader blade is supported by the support bracket. Wear strips are interposed between the retainers and the blade assembly. One purpose of the wear strips is to maintain a tight fit between the retainers and the blade assembly.

During use of the grader, the grader group is moved over the ground by the tractor unit such that the grader blade engages the dirt to perform one of the aforementioned work functions. The engagement of the dirt by the grader blade causes the communication of a large force to the wear strips. This force causes the wear strips to erode. Erosion of the wear strips causes the fit between the blade assembly and the retainers to become loose. As the fit becomes loose, the grader blade randomly moves about relative to the support bracket. A loose grader blade inhibits the accurate displacement, distribution or leveling of dirt. Therefore, the fit between the retainers and the blade assembly must be tightened frequently as the wear strips erode.

Tightening the fit between the retainers and the blade assembly has heretofore largely depended upon inserting shims between the eroded wear strip and the retainer. However, using shims is work intensive, and thus increases the maintenance cost of the grader. Moreover, the insertion of shims only inhibits, and does not effectively stop, the movement of the grader blade relative to the support bracket.

An additional problem encountered with graders is that as the grader blade engages the ground, dirt moves up and over the blade and falls into a gap defined between the grader blade and the support bracket. The presence of dirt in this gap causes additional wear on the grader, and thus increases its maintenance cost.

It would therefore be desirable to provide an apparatus for retaining a grader blade which facilitates tightening of the fit between the retainers and the blade assembly that is inexpensive. It would also be desirable to provide an apparatus for retaining a grader blade which facilitates tightening of the fit between the retainers and the blade assembly that does not require shims. It would further be desirable to provide an apparatus for retaining a grader blade which is configured so as to reduce the wear of the wear strips. It would still further be desirable to provide an apparatus for retaining a grader blade which facilitates tightening of the fit between the retainers and the blade assembly that substantially eliminates any movement of the grader blade relative to the support bracket. It would still further be desirable to provide an apparatus for retaining a grader blade that prevents material from being deposited in the gap defined between the grader blade and the support bracket.

SUMMARY OF THE INVENTION

The above and other objects, features and advantages of the present invention will become apparent from the following description and attached drawings.

In accordance with one embodiment of the present invention an apparatus for retaining a grader blade is provided. The apparatus includes a support bracket and a first retainer secured to the support bracket. The apparatus also includes a second retainer movable relative to the first retainer. The apparatus further includes an adjustment member which contacts the second retainer, wherein rotation of the adjustment member causes movement of the second retainer relative to the first retainer.

In accordance with another embodiment of the present invention there is provided an apparatus for retaining a grader blade. The apparatus includes a support bracket, a first upper retainer secured to the support bracket and a second upper retainer secured to the support bracket. The apparatus also includes a first lower retainer secured to the support bracket, the first lower retainer being movable relative to the first upper retainer, and a second lower retainer secured to the support bracket, the second lower retainer being movable relative to the second upper retainer. The apparatus further includes a first adjustment member which contacts the first lower retainer, wherein rotation of the first adjustment member causes movement of the first lower retainer relative to the first upper retainer, and a second adjustment member which contacts the second lower retainer, wherein rotation of the second adjustment member causes movement of the second lower retainer relative to the second upper retainer.

In accordance with yet another embodiment of the present invention there is provided a method of retaining a grader blade relative to a support bracket, with (1) the support bracket having an upper retainer and a lower retainer secured thereto, (2) the support bracket having an aperture defined therein. The method includes the steps of (1) positioning the lower retainer at a first position relative to the upper retainer with an adjustment member wherein the adjustment member is positioned within the aperture defined in the support bracket, (2) supporting a grader blade with the upper retainer and the lower retainer, (3) performing a grading operation with the grader blade after the positioning steps, and, (4) rotating the adjustment member after the performing steps, so that the lower retainer is positioned at a second position relative to the upper retainer.

It is therefore an object of this invention to provide a new and useful apparatus for retaining a grader blade.

It is another object of this invention to provide an improved apparatus for retaining a grader blade.

It is yet another object of this invention to provide a new and useful method for retaining a grader blade.

It is still another object of this invention to provide an improved method of retaining a grader blade.

It is still another object of this invention to provide an apparatus and method for retaining a grader blade which facilitates tightening of the fit between the retainers and the blade assembly of a grader that is relatively inexpensive.

It is yet another object of this invention to provide an apparatus and method for retaining a grader blade which facilitates tightening of the fit between the retainers and the blade assembly of a grader that does not require shims.

It still another object of this invention to provide an apparatus for retaining a grader blade which is configured so as to reduce the wear of the wear strips.

It is yet another object of this invention to provide an apparatus and method for retaining a grader blade which facilitates tightening of the fit between the retainers and the blade assembly of a grader that substantially eliminates any movement of the grader blade relative to the support bracket.

It is still another object of this invention to provide an apparatus for retaining a grader blade that prevents material from being deposited in the gap defined between the grader blade and the support bracket.

The above and other objects, features, and advantages of the present invention will become apparent from the following description and the attached drawings.

DETAILED DESCRIPTION OF THE PREFERRED EMBODIMENT

Figure 1:
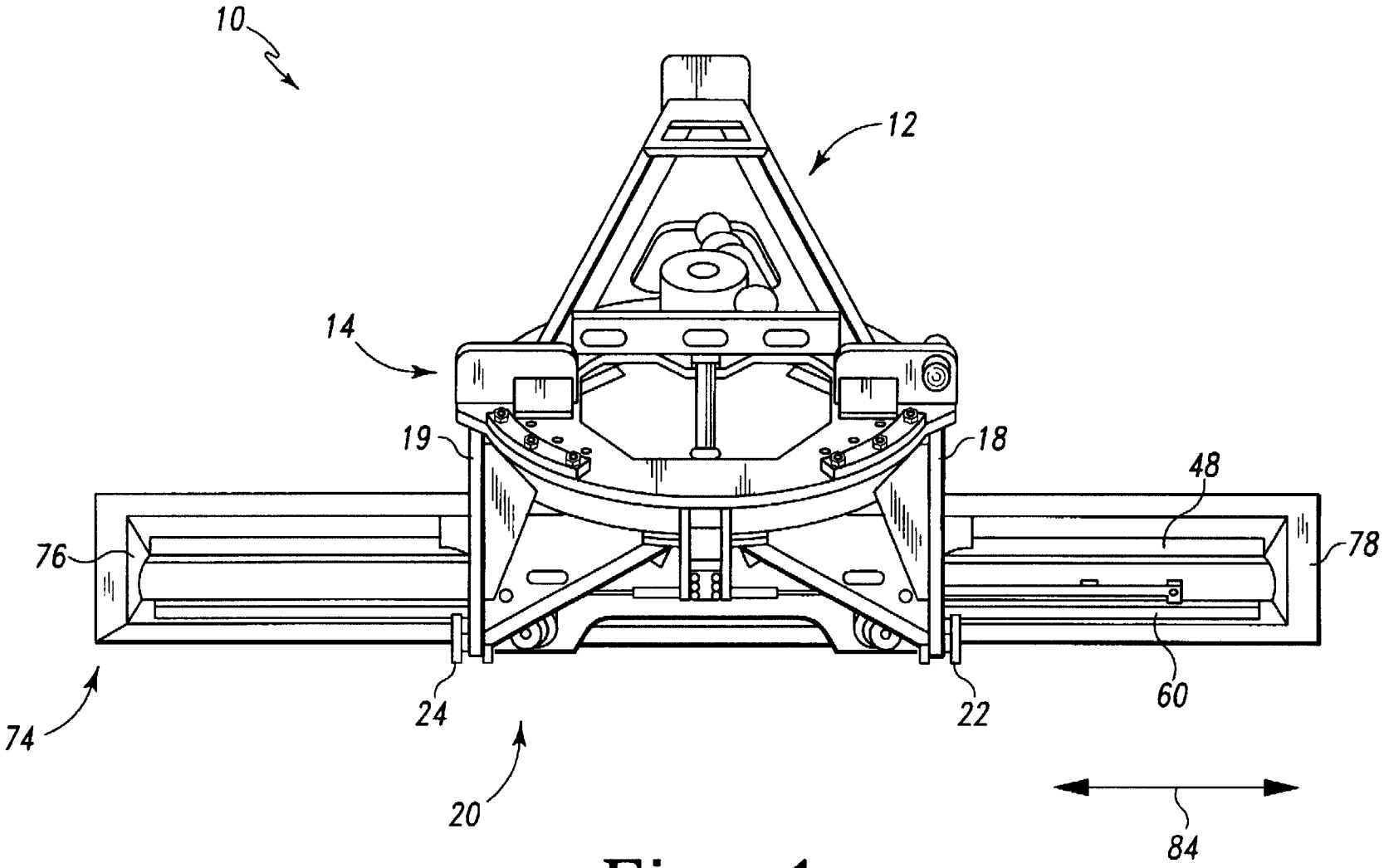
FIG. 1 is an elevational view end view of a grader group which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
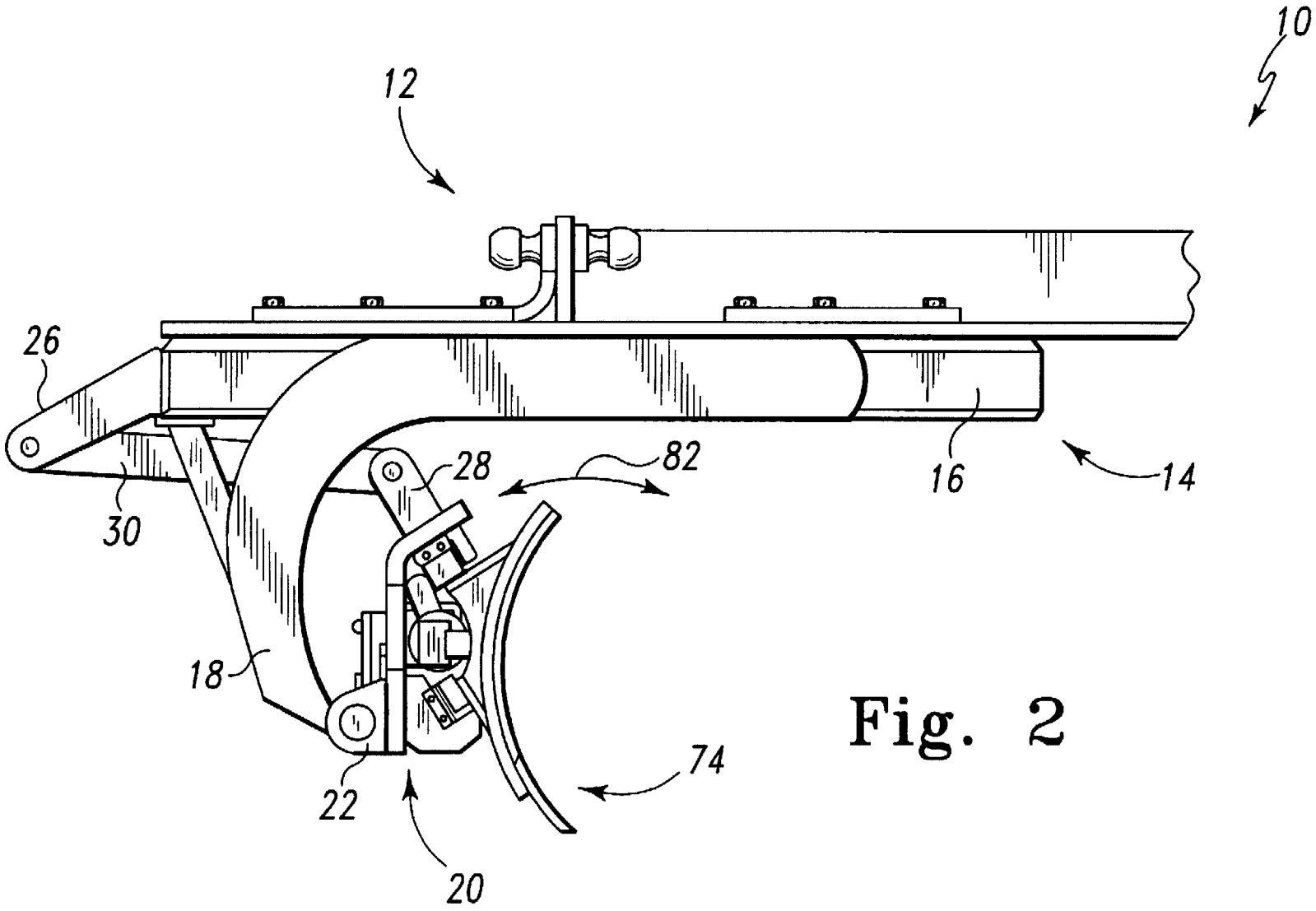
FIG. 2 is an enlarged fragmentary side elevational view of the grader group shown in FIG. 1.

Referring now to FIGS. 1 and 2, there is shown a grader group 10 which incorporates the features of the present invention. Grader group 10 includes a tow bar assembly 12, a circle assembly 14 and an apparatus 20 for retaining a grader blade (hereinafter referred to as "retaining apparatus"). Grader group 10 also includes a blade assembly 74. Tow bar assembly 12 is secured to circle assembly 14. Circle assembly 14 is secured to retaining apparatus 20. Retaining apparatus 20 is secured to, and supports, blade assembly 74. During a grading operation tow bar assembly 12 is coupled to a tractor unit (not shown) of a grader (not shown) in a well known manner such that grader group 10 is moved over the ground to perform various grading functions.

Circle assembly 14 includes a circle member 16, a first blade beam 18 and a second blade beam 19. First blade beam 18 and second blade beam 19 are secured to circle member 16. First blade beam 18 is pivotally mounted in a first pivot flange 22 fixed to retaining apparatus 20. Second blade beam 19 is pivotally mounted in a second pivot flange 24 fixed to retaining apparatus 20. Circle assembly 14 also includes a first tip flange 26 extending therefrom. First tip flange 26 is coupled to a hydraulic cylinder 30. Hydraulic cylinder 30 is also coupled to a second tip flange 28 fixed to retaining apparatus 20. Actuation of hydraulic cylinder 30 causes retaining apparatus 20 and blade assembly 74 to pivot relative to first blade beam 18 and second blade beam 19 in the directions indicated by arrow 82.

Figure 4:
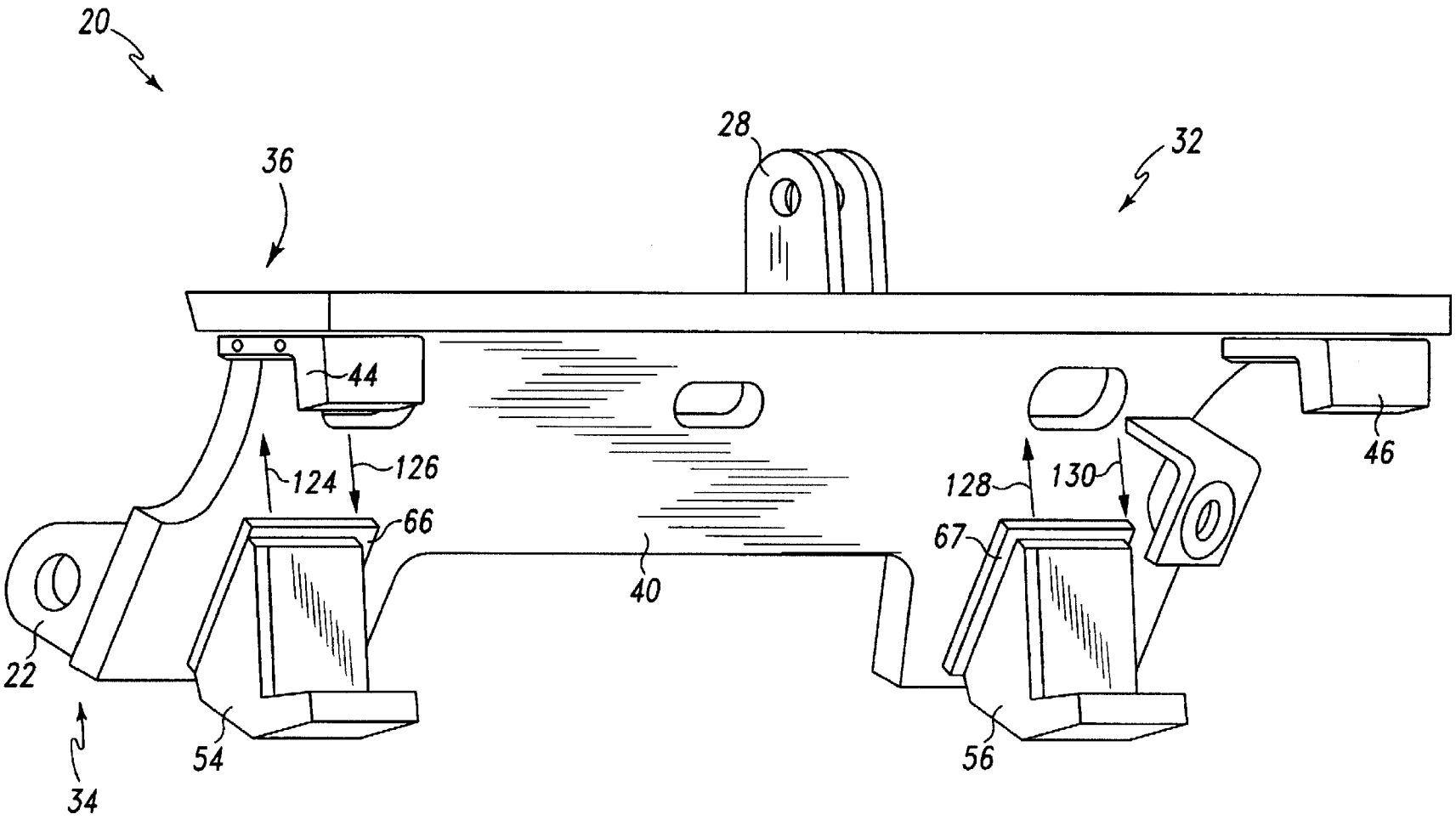
FIG. 4 is a perspective view showing the inner surface of the support bracket of FIG. 3, with all the components removed therefrom for clarity of description, except for the plates, the upper retainers, the lower retainers, the first pivot flange and the second tip flange.
Figure 5:
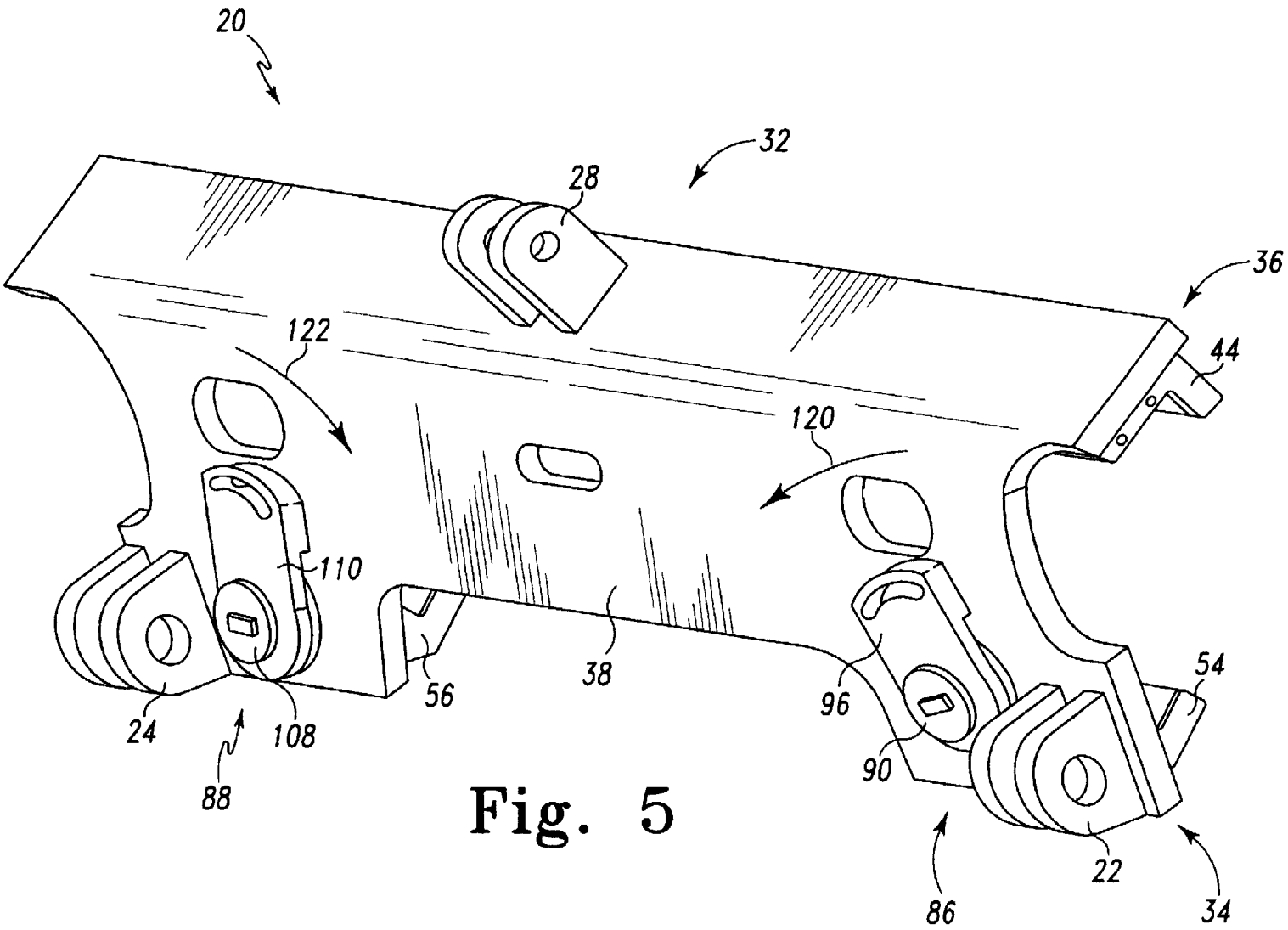
FIG. 5 is a perspective view showing the outer surface of the support bracket of FIG. 4, with the first and second adjustment assemblies shown attached thereto.
Figure 6:
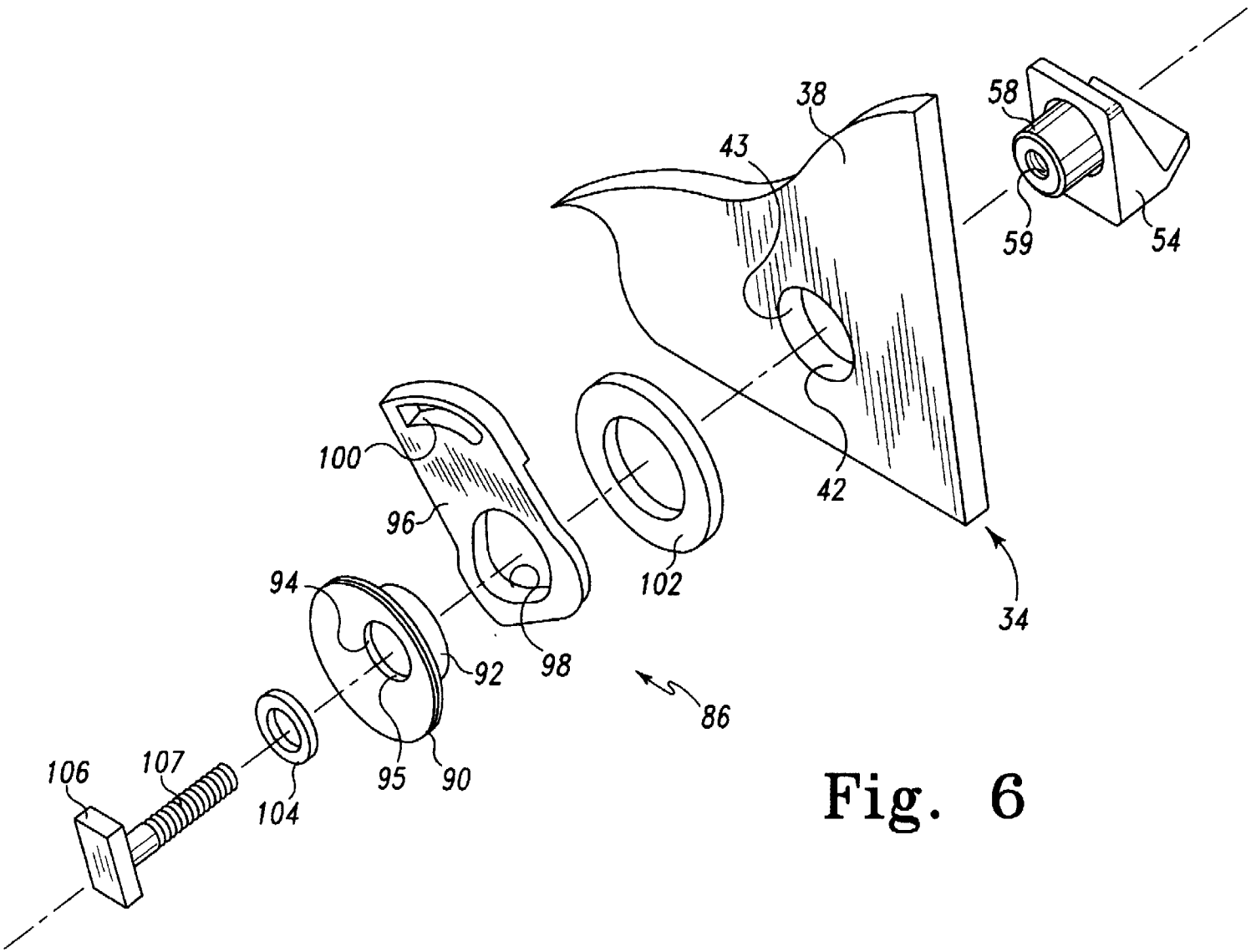
FIG. 6 is a fragmentary perspective view of the retainer bracket shown in FIGS. 4 and 5, with the first adjustment assembly shown in an exploded view for clarity of description.

As shown in FIGS. 3, 4, 5 and 6, retaining apparatus 20 includes a support bracket 32 having a lower portion 34 and an upper portion 36. Upper portion 36 is positioned relative to lower portion 34 such that upper portion 36 and lower portion 34 define an obtuse angle therebetween (i.e. the angle defined between upper portion 36 and lower portion 34 is greater than 90 E but less than 180 E). Support bracket 32 also has an outer surface 38 and an inner surface 40. Support bracket 32 further includes a pair of apertures 42 defined in lower portion 34 (see FIG. 6: note that only one aperture 42 is shown in FIG. 6). A first plate 66 having a hole therethrough (not shown) is welded to inner surface 40. First plate 66 is welded to inner surface 40 such that the hole in first plate 66 aligns with one of the apertures 42 defined in support bracket 32. A second plate 67 having a hole therethrough (not shown) is welded to inner surface 40. Second plate 67 is welded to inner surface 40 such that the hole in second plate 67 aligns with the other aperture 42 defined in support bracket 32.

Retaining apparatus 20 also includes a first upper retainer 44 and a second upper retainer 46 secured to upper portion 36 of support bracket 32. Retaining apparatus 20 further includes a first lower retainer 54 and a second lower retainer 56. First lower retainer 54 and second lower retainer 56 each include a retainer cylinder 58 extending therefrom. Each retainer cylinder 58 has an internally threaded portion 59. Note that only first lower retainer 54 and retainer cylinder 58 extending therefrom is shown in FIG. 6.

It should be understood that retaining apparatus 20 can include more than first upper retainer 44 and second upper retainer 46. For example, retaining apparatus 20 can include a third upper retainer (not shown), or more than three upper retainers. It should also be understood that apparatus 20 can include a single upper retainer (not shown) which extends substantially along the length of upper portion 36.

First lower retainer 54, is positioned relative to lower portion 34 of support bracket 32 such that first lower retainer 54 contacts first plate 66. First lower retainer 54 is further positioned relative to lower portion 34 such that retainer cylinder 58 extends through one of the apertures 42 of support bracket 32.

In a similar manner, second lower retainer 56 is positioned relative to lower portion 34 of support bracket 32 such that second lower retainer 56 contacts second plate 67. Second lower retainer 56 is further positioned relative to lower portion 34 such that its retainer cylinder 58 extends through the other aperture 42.

It should be understood that the diameter of apertures 42 and the outer diameter of retainer cylinders 58 are such that when retainer cylinders 58 are positioned in apertures 42 there is a space between sidewall 43 of apertures 42 and retainer cylinders 58. Therefore, first lower retainer 54 and second lower retainer 56 can move relative to first upper retainer 44 and second upper retainer 46 in the directions indicated by arrows 124, 126, 128 and 130 when retainer cylinders 58 are positioned in apertures 42.

As shown in more detail in FIGS. 5 and 6, retaining apparatus 20 further includes a first adjustment assembly 86 and a second adjustment assembly 88. The following description is in reference to first adjustment assembly 86, however it should be understood that second adjustment assembly 88 has corresponding elements and is constructed in the same way as first adjustment assembly 86. Moreover, second adjustment assembly 88 functions in a similar way as first adjustment assembly 86. First adjust assembly 86 includes a first adjustment member 90, a first flange 96, a first ring 102, a first washer 104 and a first stud 106.

In the embodiment described herein, first adjustment member 90 is an annular cam. First adjustment member 90 includes a first cylinder 92 extending therefrom. As shown more clearly in FIG. 7, first adjustment member 90 also includes an opening 94 extending therethrough. It should be understood that opening 94 is eccentrically located relative to a center C of adjustment member 90. However, center C is the center of both, first cylinder 92 and first adjustment member 90. It should also be understood that first adjustment member 90 can have any geometric shape as long as first adjustment member 90 has an opening therethrough that is eccentrically located relative to a center thereof.

Figure 7:
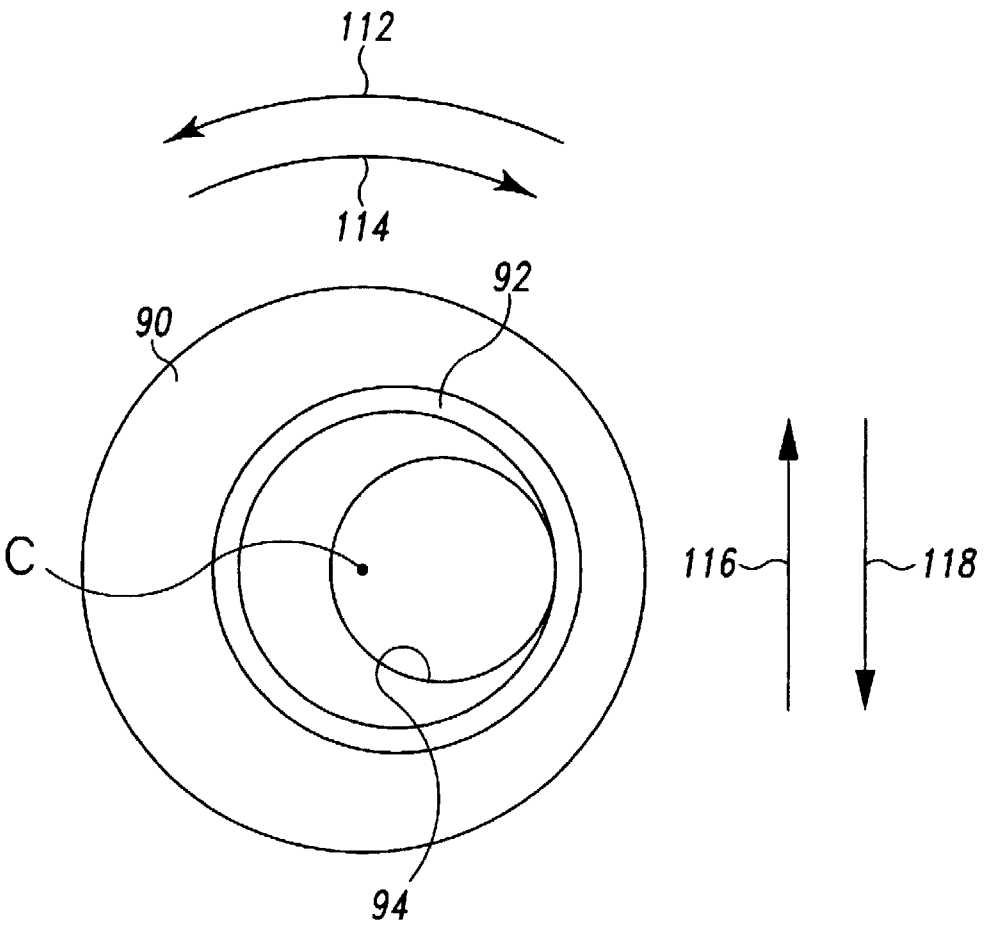
FIG. 7 is a front elevational view of the adjustment member of FIG. 6.

Having opening 94 eccentrically located relative to center C of first adjustment member 90 causes opening 94 to move in a upward direction (as indicated by arrow 116 in FIG. 7) when first adjustment member 90 is rotated in a direction indicated by arrow 112 of FIG. 7. In addition, the above described eccentricity causes opening 94 to move in a downward direction (as indicated by arrow 118 in FIG. 7) when first adjustment member 90 is rotated in a direction indicated by arrow 114 of FIG. 7.

As shown in FIG. 6, first flange 96 has a hole 98 and a slot 100 defined therein. First flange 96 is welded to first adjustment member 90 such that first cylinder 92 extends through hole 98.

First adjustment member 90, first flange 96 and first ring 102 are positioned relative to lower portion 34 such that first cylinder 92 is positioned in aperture 42 and contacts sidewall 43, with first ring 102 interposed between first flange 96 and lower portion 34. First adjustment member 90 is further positioned relative to lower portion 34 such that retainer cylinder 58 of lower retainer 54 is positioned within first cylinder 92 and opening 94. Opening 94 has a diameter such that retainer cylinder 58 contacts an opening wall 95 (see FIG. 6).

Stud 106 is inserted through first washer 104, opening 94, hole 98, first ring 102 and aperture 42. Stud 106 is further inserted such that an externally threaded portion 107 defined therein contacts internally threaded portion 59 of first lower retainer 54. Stud 106 is rotated relative to first lower retainer 54 such that externally threaded portion 107 meshingly engages internally threaded portion 59 and causes stud 106 to move toward first lower retainer 54. Stud 106 is further rotated in the above described manner until lower retainer 54 and first adjustment assembly 86 are secured to lower portion 34 of support bracket 32.

It should be understood that having first adjustment assembly 86 secured to lower portion 34 in the above described manner allows first flange 96, and therefore first adjustment member 90, to be rotated relative to support bracket 32 in a direction indicated by arrow 120 (see FIG. 5). First flange 96, and therefore first adjustment member 90, can also be rotated in a direction relative to support bracket 32 in a direction opposite to the direction indicated by arrow 120.

In a similar fashion, having second adjustment assembly 88 secured to lower portion 34 in the above described manner allows second flange 110, and therefore second adjustment member 108, to be rotated relative to support bracket 32 in a direction indicated by arrow 122 (see FIG. 5). Second flange 110, and therefore second adjustment member 108, can also be rotated relative to support bracket 32 in a direction opposite to the direction indicated by arrow 122.

Having retainer cylinder 58 of first lower retainer 54 positioned within opening 94, and having opening 94 eccentrically located relative to center C of first adjustment member 90, results in vertical movement of first lower retainer 54 relative to first upper retainer 44 upon rotation of first adjustment member 90 in the direction indicated by arrow 120 of FIG. 5. Specifically, rotation of first adjustment member 90 in the direction indicated by arrow 120 of FIG. 5 results in vertically moving first lower retainer 54 in the direction indicated by arrow 124 of FIG. 4. Therefore, it should be understood that first lower retainer 54 can be moved from a first position (as shown in FIG. 4) to a second position (not shown) upon rotation of first adjustment member 90 in the direction indicated by arrow 120 of FIG. 5.

It should also be appreciated that rotation of first adjustment member 90 in a direction opposite to the direction indicated by arrow 120 results in first lower retainer 54 vertically moving in the direction indicated by arrow 126 of FIG. 4. Therefore, it should be understood that first lower retainer 54 can also be moved from the second position (not shown) to the first position (see FIG. 4) by rotating first adjustment member 90 in the direction opposite to the direction indicated by arrow 120 of FIG. 5

Rotation of second flange 110, and therefore second adjustment member 108, causes vertical movement of second lower retainer 56 relative to second upper retainer 46 in a manner similar to that described above. However, opening 94 of second adjustment member 108 is positioned relative to aperture 42 such that rotation of second adjustment member 108 in the direction indicated by arrow 122 of FIG. 5 causes second lower retainer 56 to move in the vertical direction indicated by arrow 128 of FIG. 4. Whereas rotation of second adjustment member 108 in a direction opposite to the direction indicated by arrow 122 causes second lower retainer 56 to move in the vertical direction indicated by arrow 130 of FIG. 4. Thus it should be understood that second lower retainer 56 can also be moved from a first position (as shown in FIG. 4) to a second position (not shown) by the rotation of second adjustment member 108 in the described manner.

Figure 8:
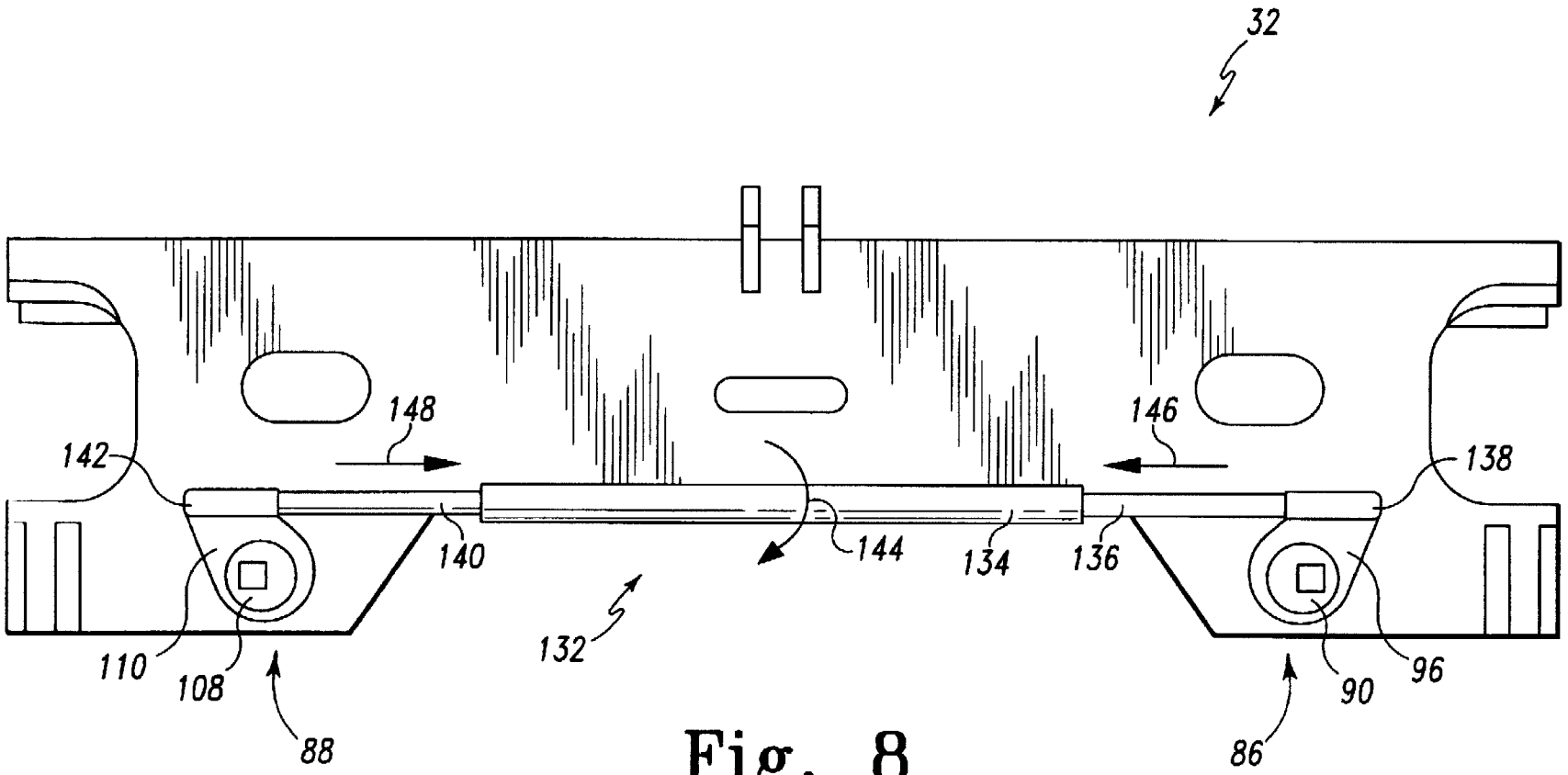
FIG. 8 is an elevational view showing the outer surface of the support bracket of FIG. 4, with a movement actuator shown coupled to the first and second adjustment assemblies.

As shown in FIG. 8, first adjustment member 90 and second adjustment member 108 are coupled together via a movement actuator 132. Movement actuator 132 includes a first shaft 136, a second shaft 140, a turnbuckle 134, a first end piece 138 and a second end piece 142. First end piece 138 is attached to an end of first shaft 136 and to first flange 96. Second end piece 142 is attached to an end of second shaft 140 and to second flange 110. The end of first shaft 136 opposite to the one attached to first end piece 138 is inserted into turnbuckle 134. The end of second shaft 140 opposite to the one attached to second end piece 142 is also inserted into turnbuckle 134. First shaft 136 and second shaft 140 are meshingly engaged by turnbuckle 134 by complementary threads.

As a result of this meshing engagement, rotation of turnbuckle 134 in a direction indicated by arrow 144 of FIG. 8 causes first shaft 136 to move in a direction indicated by arrow 146, and second shaft 140 to move in a direction indicated by arrow 148. Rotation of turnbuckle 134 in a direction opposite to the direction indicated by arrow 144 causes first shaft 136 to move in the direction indicated by arrow 148 and second shaft 140 to move in the direction indicated by arrow 146. Movement of first shaft 136 and second shaft 140 as described above causes first adjustment member 90 and second adjustment member 108 to rotate in the corresponding directions. Therefore, first lower retainer 54 and second lower retainer 56 are moved in the vertical directions relative to first upper retainer 44 and second upper retainer 46 as indicated by arrows 124, 126, 128 and 130 of FIG. 4 depending upon the movement of first shaft 136 and second shaft 140.

Now referring back to FIGS. 1 and 3, blade assembly 74 includes a reinforcement member 76 having an upper blade rail 48 welded thereto, and a lower blade rail 60 welded thereto. Upper blade rail 48 and lower blade rail 60 extend substantially along the length of blade assembly 74 as shown in FIG. 1 to define the portions of the blade assembly for mounting the blade. Blade assembly 74 also includes a support member 78 welded to reinforcement member 76. Support member 78 has a grader blade 80 secured thereto.

Upper blade rail 48 is positioned in first upper retainer 44 and second upper retainer 46 (see FIG. 4). A first L-shaped wear strip 50 is interposed between upper blade rail 48 and the upper retainers (i.e. first upper retainer 44 and second upper retainer 46). A first upper end piece 52 is attached to first upper retainer 44 and a second upper end piece (not shown) is attached to second upper retainer 46 to keep first L-shaped wear strip 50 in place.

In a similar fashion, lower blade rail 60 is positioned in first lower retainer 54 and second lower retainer 56. A second L-shaped wear strip 62 is interposed between lower blade rail 60 and the lower retainers (i.e. first lower retainer 54 and second lower retainer 56). A first lower end piece 64 is attached to first lower retainer 54 and a second lower end piece (not shown) is attached to second lower retainer 56 to keep second L-shaped wear strip 62 in place.

The fact that first L-shaped wear strip 50 and second L-shaped wear strip 62 are in the shape of an "L" increases the surface area that is in contact with upper blade rail 48 and lower blade rail 60, respectively. Having an increased surface area in contact with upper blade rail 48 and lower blade rail 60 increases the wear life of first L-shaped wear strip 50 and second L-shaped wear strip 62.

Having upper blade rail 48 positioned in first upper retainer 44 and second upper retainer 46, and lower blade rail 60 positioned in first lower retainer 54 and second lower retainer 56 supports grader blade 80 in retaining apparatus 20. Once grader blade 80 is supported and appropriately positioned in retaining apparatus 20, first adjustment member 90 and second adjustment member 108 are rotated by movement actuator 132 (see FIG. 8) in directions indicated by arrows 120 and 122 of FIG. 5, respectively. Rotation of first adjustment member 90 and second adjustment member 108 in this manner causes first lower retainer 54 and second lower retainer 56 to move relative to first upper retainer 44 and second upper retainer 46 in the vertical directions indicated by arrows 124 and 128 of FIG. 4.

As a result of this vertical movement, the fit between upper blade rail 48 and the upper retainers (i.e. first upper retainer 44 and second upper retainer 46) is tightened. Moreover, the fit between lower blade rail 60 and the lower retainers (i.e. first lower retainer 54 and second lower retainer 56) is tightened. The above described tightening locks upper blade rail 48 and lower blade rail 60 into position, thereby locking grader blade 80 into position. Locking grader blade 80 into position substantially eliminates any movement of grader blade 80 relative to support bracket 32. Once locked into position grader blade 80 can displace, distribute or level material, such as dirt.

It should also be understood that grader blade 80 can be unlocked and repositioned relative to retaining apparatus 20 by rotating first adjustment member 90 and second adjustment member 108 in the appropriate directions to unlock upper blade rail 48 and lower blade rail 60. Once unlocked, grader blade 80 can be repositioned relative to retaining apparatus 20 and then locked into a new position. For example, grader blade 80 can be moved relative to retaining apparatus 20 (by hydraulic cylinder assembly 72; see FIG. 3) in one of the directions indicated by arrow 84 of FIG. 1, and then locked into position by the rotation of first adjustment member 90 and second adjustment member 108. It is contemplated that the rotation of first adjustment member 90 and second adjustment member 108 can be controlled by an operator positioned in a cab (not shown) of the grader (not shown) via a mechanical linkage.

Furthermore, it should be appreciated that having grader blade 80 in the locked position is an important aspect of the invention, since it facilitates performance of grader work functions that require very accurate grader blade 80 positioning. However, grader work functions that do not require such accurate grader blade 80 positioning can be performed wherein first adjustment member 90 and second adjustment member 108 are rotated to a point such that there is a fixed clearance between the blade rails (i.e. upper blade rail 48 and lower blade rail 60) and the retainers (i.e. first upper retainer 44, second upper retainer 46, first lower retainer 54 and second lower retainer 56).

Figure 3:
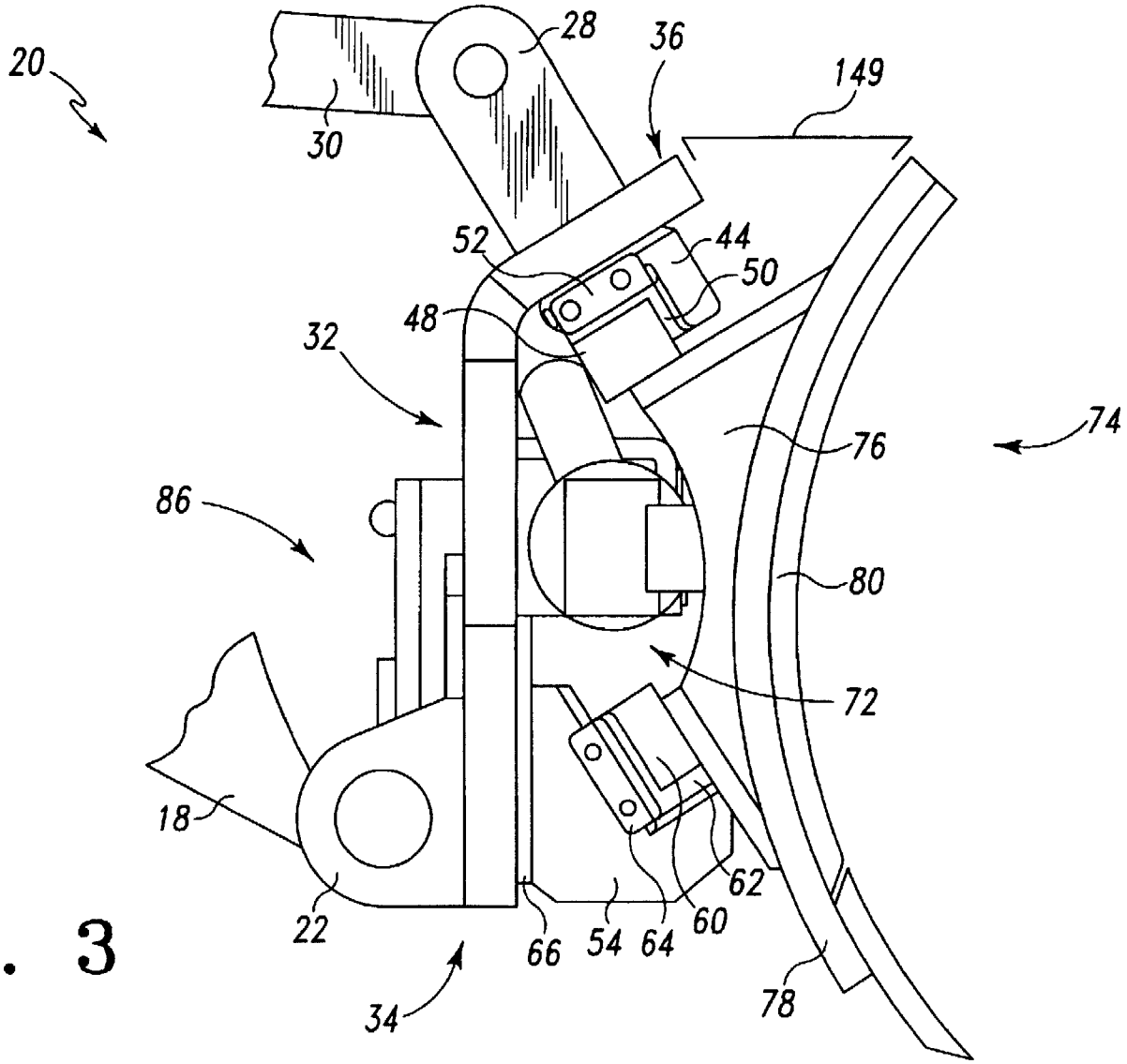
FIG. 3 is an enlarged fragmentary side elevational view of the apparatus for retaining a grader blade shown in FIG. 2.

As grading operations are performed, first L-shaped wear strip 50 and second L-shaped wear strip 62 gradually wear (see FIG. 3). This wear causes upper blade rail 48 to become loose beyond an acceptable tolerance while positioned in first upper retainer 44 and second upper retainer 46. The wear also causes lower blade rail 60 to become loose beyond an acceptable tolerance while positioned in first lower retainer 54 and second lower retainer 56. The loosening of upper blade rail 48 and lower blade rail 60 allows excessive movement of grader blade 80 relative to support bracket 32. The aforementioned movement is substantially eliminated by rotating first adjustment member 90 and second adjustment member 108 in the appropriate direction as described above, thus tightening the lock on grader blade 80. Therefore, it should be understood that the need for shims is eliminated.

Figure 9:
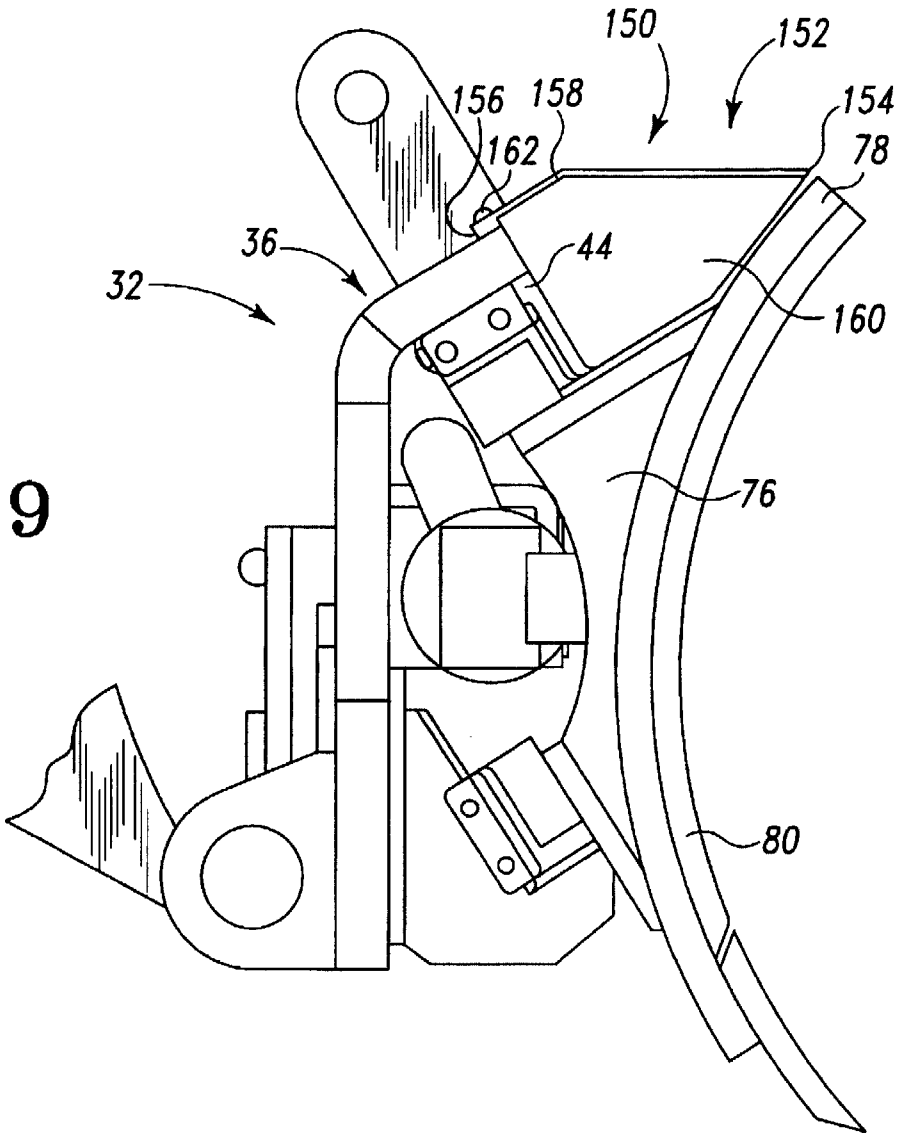
FIG. 9 is a side elevational view of the apparatus for retaining a grader blade shown in FIG. 3, with a rock guard shown attached thereto.
Figure 10:
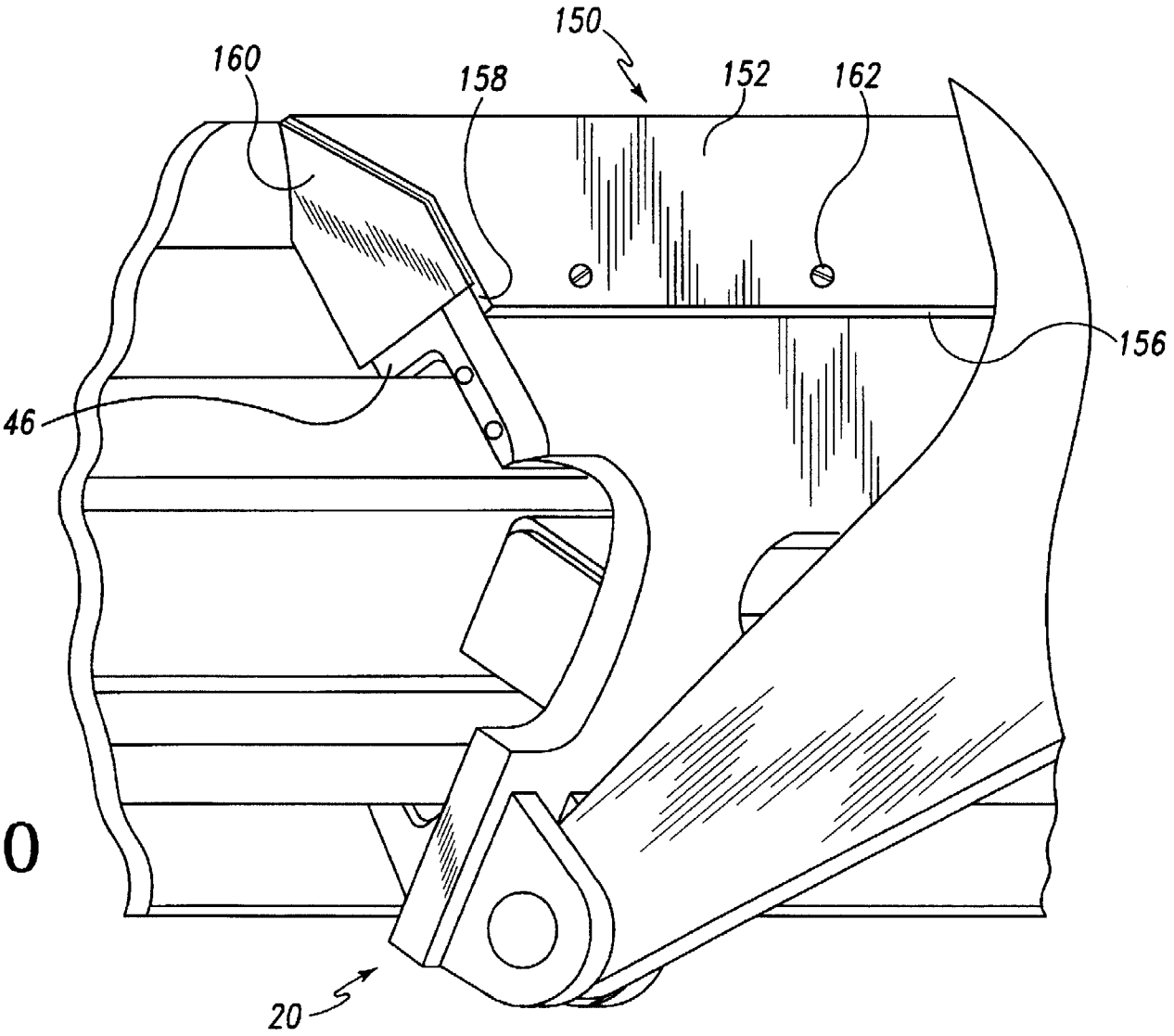
FIG. 10 is a perspective view of the rock guard and apparatus for retaining a grader blade of FIG. 9.

Now referring to FIGS. 9 and 10, there is shown a rock guard 150 attached to upper portion 36 of support bracket 32. Rock guard 150 includes an elongated top panel 152 having a front edge 154, a rear edge 156, a first side edge 158 and a second side edge (not shown). Elongated top panel 152 is secured to upper portion 36 with screws 162 such that front edge 154 is positioned adjacent to support member 78. However, it should be understood that elongated top panel 152 and support member 78 are separated by a distance. Having elongated top panel 152 attached to upper portion 36 in the above described manner covers a gap 149 (see FIG. 3) defined between support bracket 32 and grader blade 80. Rock guard 150 also includes a first side panel 160 secured to first side edge 158 and a second side panel (not shown)

secured to second side edge (not shown). It should be understood that having rock guard secured to upper portion in the above described manner covers gap 149 while allowing grader blade 80 to move relative to retaining apparatus 20 (by hydraulic cylinder assembly 72 see FIG. 3) in one of the directions indicated by arrow 84 of FIG. 1.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected. For example, movement actuator 132 is described above as including turnbuckle 134. It should be understood that turnbuckle 134 may be manually rotated by a tool such as a wrench, or automatically rotated with a hydraulic cylinder coupled thereto with a mechanical linkage. Moreover, it should be appreciated that the turnbuckle 134 may be omitted and the first shaft 136 and second shaft 140 may be directly coupled to one or more hydraulic cylinders for linear movement in the direction of arrows 146 and 148, respectively. Furthermore, it should be understood that first lower retainer 54 and second lower retainer 56 can include retainer cylinders, respectively extending therefrom, that have an externally threaded portion thereon as opposed to an internally threaded portion. First lower retainer 54 and second lower retainer 56 having the externally threaded portion thereon are respectively secured to lower portion 34, first adjustment assembly 86 and second adjustment assembly 88 in a manner similar to that described above. However, instead of using stud 106 for securing, the retainer cylinders have a length such that a segment of the externally threaded portions respectively extend out from opening 94 of adjustment member 90 and adjustment member 108, and a nut is screwed onto the externally threaded portions of the retainer cylinders to secure the elements together.

What is claimed is:

1. An apparatus for retaining a grader blade having upper and lower blade rails, comprising:

support bracket;

a first retainer secured to said support bracket and being positionable in contact with one of said upper and lower blade rails;

a second retainer movable relative to said first retainer and being positionable in contact with the other of said upper and lower blade rails, said first retainer and said second retainer cooperatly to secure said grader blade in fixed relation to said support bracket; and an adjustment member which contacts said second retainer, said adjustment member having an opening extending therethrough, said opening being eccentrically located relative to a center C of said adjustment member, adjustment member being rotatable in a first direction to cause said second retainer to move towards said first retainer, and in a second direction to cause said second retainer to move away from said first retainer.

2. The apparatus of claim 1, wherein:

said second retainer is securable to said support bracket, and said adjustment member is securable to said support bracket.

3. The apparatus of claim 2, further including a stud having an externally threaded portion, wherein:

said second retainer includes an internally threaded portion, said stud extends through said opening of said adjustment member, and said externally threaded portion of said stud meshingly engages said internally threaded portion of said second retainer.

4. The apparatus of claim 3, further comprising:

a wear strip interposed between said first retainer and the respective one of said blade rail.

5. The apparatus of claim 3, wherein:

said support bracket includes an aperture defined therein, and said stud extends through said aperture defined in said support bracket.

6. The apparatus of claim 1, wherein said first retainer and said second retainer cooperate to adjustably support said grader blade.

7. The apparatus of claim 1, wherein:

said support bracket has an upper portion and a lower portion, said upper portion is positioned relative to said lower portion such that said upper portion and said lower portion define an obtuse angle therebetween, and said first retainer is secured to said upper portion and said second retainer is secured to said lower portion.

8. The apparatus of claim 1, further comprising:

a first L-shaped wear strip interposed between said first retainer and said grader blade; and a second L-shaped wear strip interposed between said second retainer and said grader blade.

9. The apparatus of claim 1, further comprising a movement actuator for rotating said adjustment member.

10. The apparatus of claim 9, wherein said movement actuator includes:

a shaft coupled to said adjustment member; and a turnbuckle which meshingly engages said shaft.

11. The apparatus of claim 1, wherein a gap is defined between said support bracket and said grader blade, further comprising:

a rock guard positioned relative to said support bracket so as to cover said gap.

12. An apparatus for retaining a grader blade having a blade rail, comprising:

a support bracket;

a first upper retainer secured to said support bracket;

a second upper retainer secured to said support bracket;

a first lower retainer secured to said support bracket, said first lower retainer being movable relative to said first upper retainer, and said first upper retainer and said first lower retainer cooperate so as to secure said blade rail in fixed relation to said support bracket;

a second lower retainer secured to said support bracket, said second lower retainer being movable relative to said second upper retainer, and said second upper retainer and said second lower retainer cooperate so as to secure said blade rail in fixed relation to said support bracket;

a first adjustment member which contacts said first lower retainer, wherein (1) said first adjustment member has an opening extending therethough, (2) said opening is eccentrically located relative to a first center C1 of said first adjustment member, (3) rotation of said first adjustment member in a first direction causes said first lower retainer to move towards said first upper retainer, and (4) rotation of said first adjustment member in a second direction causes said first lower retainer to move away from said first upper retainer; and a second adjustment member which contacts said second lower retainer, wherein (1) said second adjustment member has an opening extending therethough, (2) said opening is eccentrically located relative to a second center C2 of said second adjustment member, (3) rotation of said second adjustment member in a first direction causes said second lower retainer to move towards said second upper retainer, and (4) rotation of said second adjustment member in a second direction causes said second lower retainer to move away from said second upper retainer.

13. The apparatus of claim 12, further comprising:

a first wear strip interposed between said first upper retainer and said blade rail; and a second wear strip interposed between said second upper retainer and said blade rail.

14. The apparatus of claim 12, wherein:

said support bracket has an upper portion and a lower portion, said upper portion is positioned relative to said lower portion such that said upper portion and said lower portion define an obtuse angle therebetween, said first upper retainer and said second upper retainer are secured to said upper portion, and said first lower retainer and said second lower retainer are secured to said lower portion.

15. The apparatus of claim 14, further comprising:

a first L-shaped wear strip interposed between said first upper retainer and said grader blade; and a second L-shaped wear strip interposed between said first lower retainer and said grader blade.

16. The apparatus of claim 12, further comprising a movement actuator for rotating said first adjustment member and said second adjustment member.

17. The apparatus of claim 16, wherein said movement actuator includes:

a first shaft coupled to said first adjustment member, a second shaft coupled to said second adjustment member, and a turnbuckle which meshingly engages said first shaft and said second shaft.

18. The apparatus of claim 17, wherein rotation of said turnbuckle causes (1) rotation of said first adjustment member, and (2) rotation of said second adjustment member.

19. A method of adjusting a grader blade relative to a support bracket, with (1) the support bracket having an upper retainer and a lower retainer secured thereto, (2) the support bracket having an aperture defined therein, comprising the steps of:

positioning said lower retainer at a first position relative to said upper retainer with an adjustment member, wherein (1) said adjustment member is positioned within said aperture defined in said support bracket, (2) said adjustment member has an opening extending therethrough, and (3) said opening is eccentrically located relative to a center C of said adjustment member;

supporting the grader blade with said upper retainer and said lower retainer;

performing a grading operation with said grader blade after the positioning step; and rotating said adjustment member after the performing step so that said lower retainer is moved to a second position relative to said upper retainer.

* * * * *